US005246238A

United States Patent [19]

Brown

[11] Patent Number: 5,246,238

[45] Date of Patent: Sep. 21, 1993

[54] ROLLER SKATE WHEEL

[76] Inventor: Nathaniel R. Brown, 23 Netherlands Rd., Brookline, Mass. 02146

[21] Appl. No.: 906,411

[22] Filed: Jun. 30, 1992

[51] Int. Cl.[5] ..... A63C 17/06; A63C 17/14

[52] U.S. Cl. ..... 280/11.2; 188/83; 280/11.22; 280/11.27; 301/5.23; 301/5.3; 301/5.7

[58] Field of Search ..... 280/11.19, 11.2, 11.22, 280/11.23, 11.24, 11.25; 301/5.3, 5.7, 5.1, 1, 5.23; 188/83, 166, 167; 180/11.27

[56] References Cited

U.S. PATENT DOCUMENTS

| | | | |
|---|---|---|---|
| 1,305,535 | 6/1919 | Grabowiecki | 301/1 |
| 2,260,027 | 10/1941 | Hotson | 280/11.19 |
| 3,789,947 | 2/1974 | Blumrich | 180/79.3 |
| 4,058,324 | 11/1977 | Dallaire | 280/11.22 |
| 4,715,460 | 12/1987 | Smith | 180/7.1 |

FOREIGN PATENT DOCUMENTS

| | | | |
|---|---|---|---|
| 822660 | 10/1951 | Fed. Rep. of Germany | 301/5 P |
| 3702660 | 11/1988 | Fed. Rep. of Germany | 301/5 P |

*Primary Examiner*—Sherman D. Basinger
*Attorney, Agent, or Firm*—Lahive & Cockfield

[57] ABSTRACT

A roller skate wheel is constructed for rolling in both the forward and lateral directions of the skate. A plurality of rollers are mounted on the wheel hub, each roller rotatable about an axis tangential to a circle on the wheel axis. The rollers conform to a second circle on the wheel axis for contact with a skating surface. Application of friction to the rollers controls the resistance to lateral rolling, thus providing a braking action to the skater.

12 Claims, 5 Drawing Sheets

ROLLER SKATE WHEEL

SUMMARY OF THE INVENTION

This invention relates generally to roller skates used primarily for recreational and sports purposes. More particularly, it relates to an improved roller skate wheel adapted for rolling action in both the forward and lateral directions of the skate.

The invention is applicable to skates having brackets or other mounts affixed to the outer sole for plural bearings to support wheels on axes normal to the forward rolling direction. A single or a pair of wheels is typically mounted on each axis with low friction bearings for ease of rolling. On in-line skates there is a single wheel on each axis and there are typically four wheels in tandem.

A limitation inherent in typical skates of this type is the difficulty of braking the motion of the skater by causing the wheels to engage the skating surface in any direction having a component lateral to the forward direction of the skate, that is, at any angle other than normal to the wheel axes. By contrast, in ice skating it is readily possible to provide a braking action by turning the runner at an angle to the direction of motion and allowing it to scrape the surface of the ice.

It is principal object of this invention to provide a roller skate adapted to facilitate braking action by rotating the forward direction of the skate relative to the direction of motion of the skater while retaining the engagement of the skate with the skating surface.

A second object is to provide a roller skate adapted for rolling in both the forward and lateral directions of the skate, with significant friction applied in the lateral direction of rolling.

A third object is to provide means for readily controlling and adjusting the degree of frictional resistance to lateral rolling.

With the foregoing and other objects hereinafter appearing in view, the features of this invention include the provision of a roller skate wheel having a hub for mounting the wheel bearings and a plurality of rollers mounted on the hub in annularly spaced relationship. The rollers have individual axes of rotation that are tangential to a common circle having its center in the wheel axis. The surfaces of the rollers have major portions that are symmetrically formed about their axes, and shaped to conform to a second circle on the wheel axis which defines the effective wheel surface for engaging the skating surface.

The skate wheel is provided with friction means located to engage the rollers to provide frictional resistance to rotation of the rollers about their individual axes, that is, normally to the forward rolling direction of the wheel.

Other features of the wheel construction will become evident from the following description of a preferred embodiment of the invention.

DRAWINGS

FIG. 1 is a side elevation of an in-line skate having wheels constructed according to the invention.

FIG. 1*a* is a front elevation corresponding to FIG. 1.

DETAILED DESCRIPTION

Figure 1:
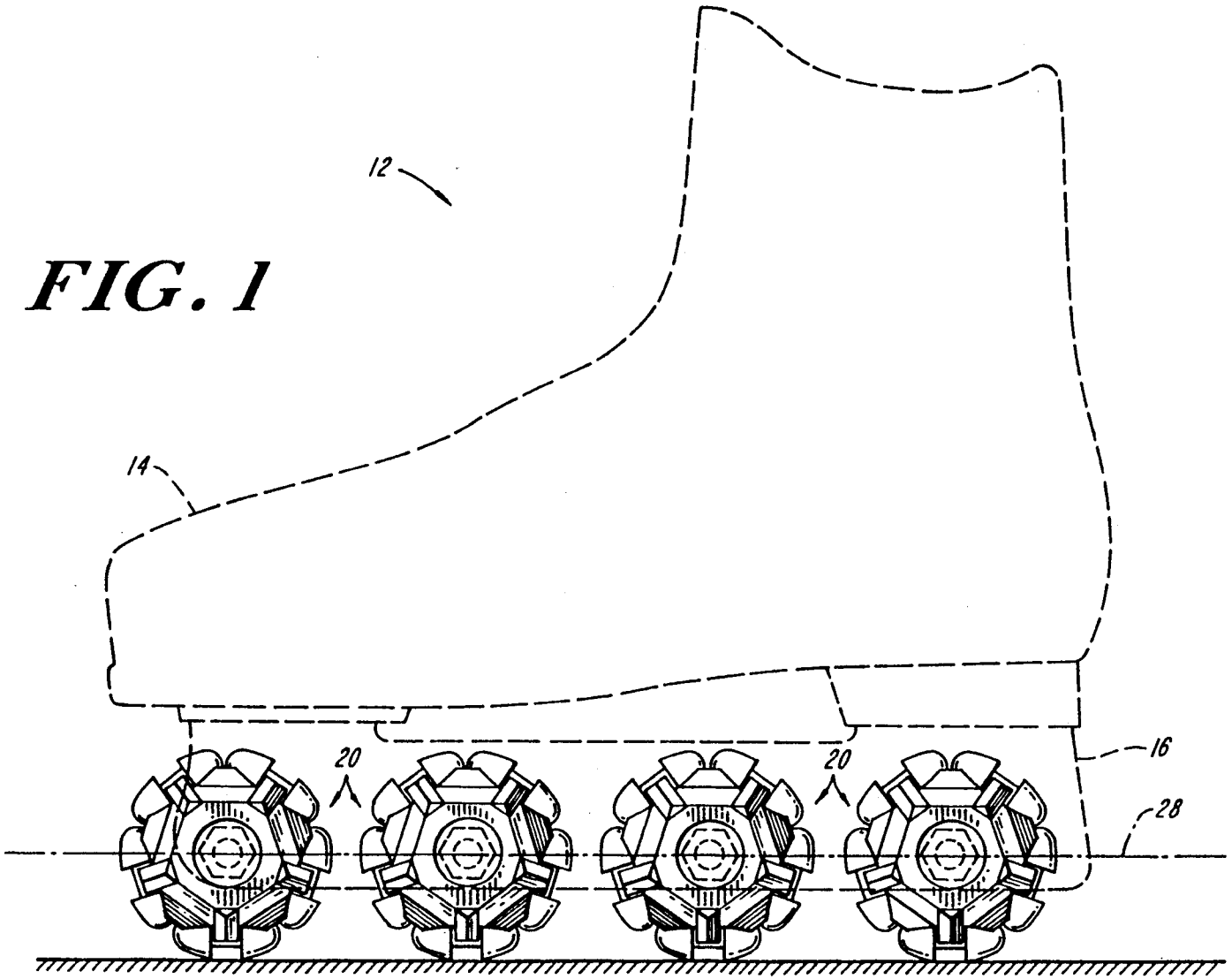
Figure 1A:
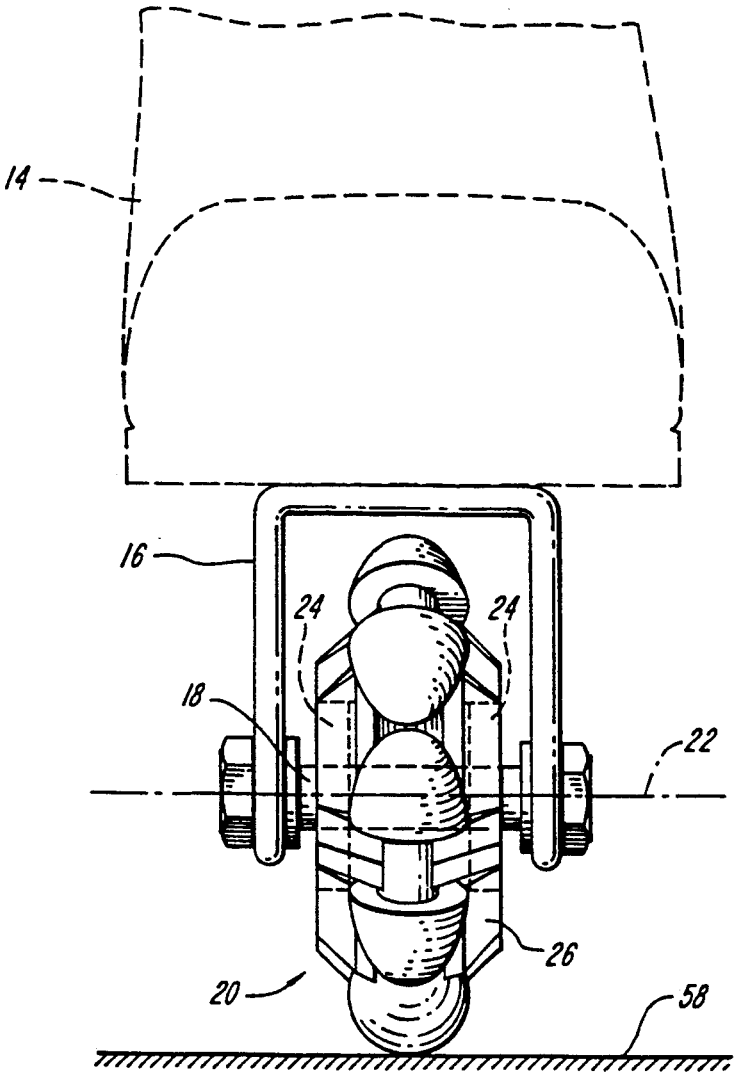

FIGS. 1 and 1*a* illustrate the presently preferred embodiment of an in-line roller skate 12 constructed according to the invention. A boot 14 has an inverted U-shaped bracket 16 secured to the outer sole. The bracket has aligned holes for four shafts 18 respectively mounting four identical wheels 20. The axes 22 of the shafts are mutually parallel and typically lie in a common plane. The forward direction of the skate is defined as the direction normal to the wheel axes.

Reference numerals 24 in FIG. 1*a* represents wheel bearings on a shaft 18 for rotatably mounting a metal wheel hub 26 on the shaft. The bearings 24 may be of any suitable form in conventional use on roller skate wheels, such as ball bearings, and allow the wheel to turn with minimal friction for rotation in the forward direction of the skate, such direction being represented by a line 28 in FIG. 1.

Figure 2:
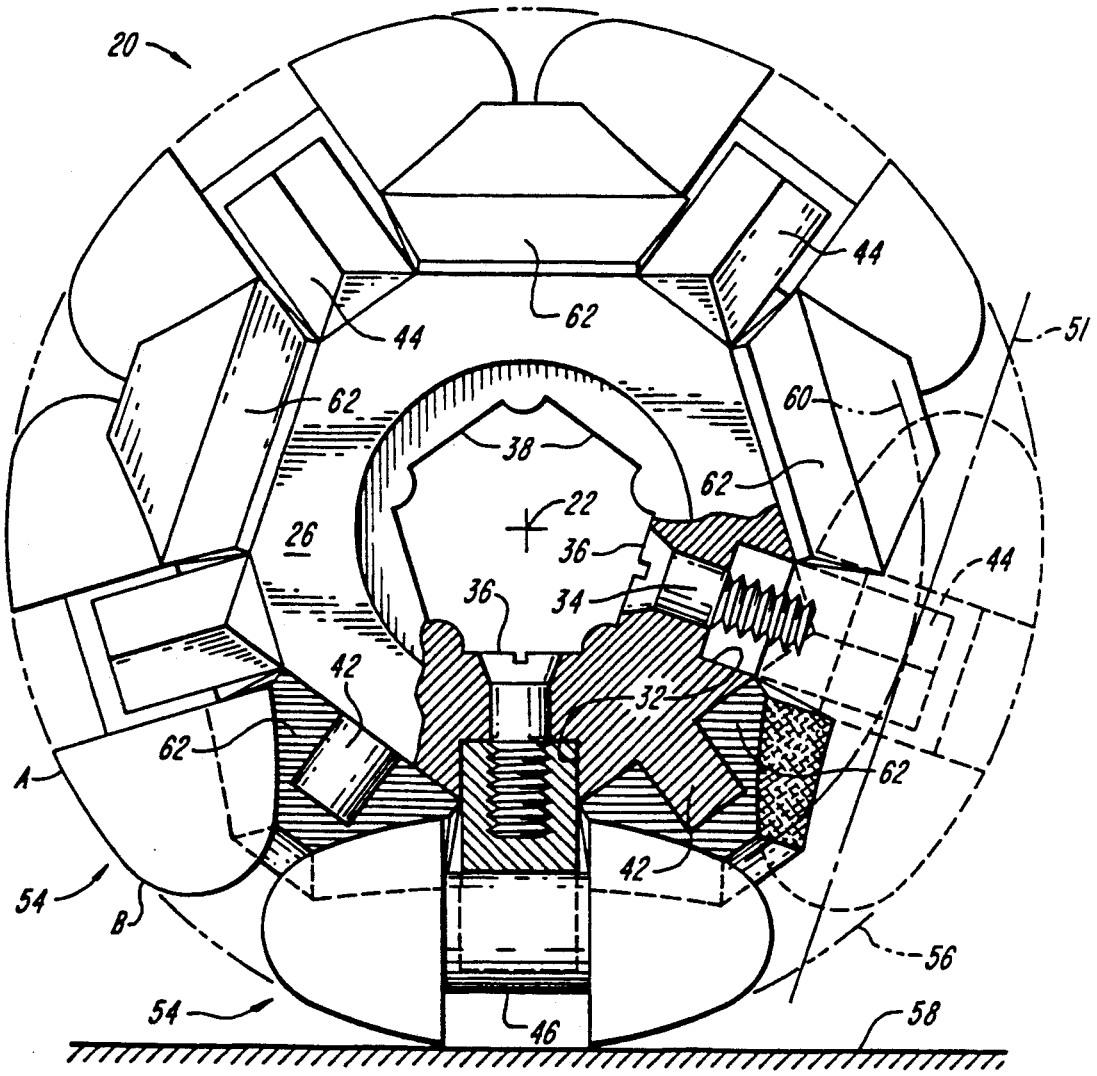
FIG. 2 is an enlarged elevation of one of the wheels of FIG. 1.
Figure 3:
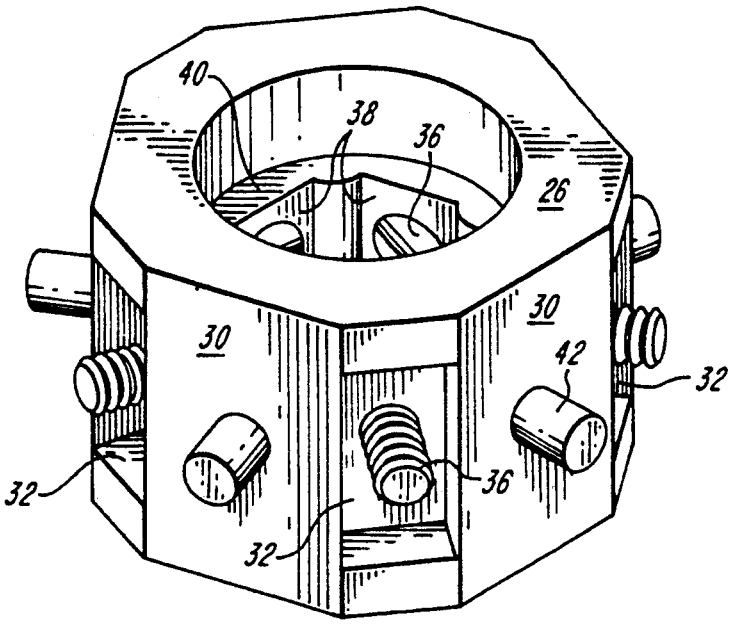
FIG. 3 is an oblique elevation of the wheel hub.
Figure 5:
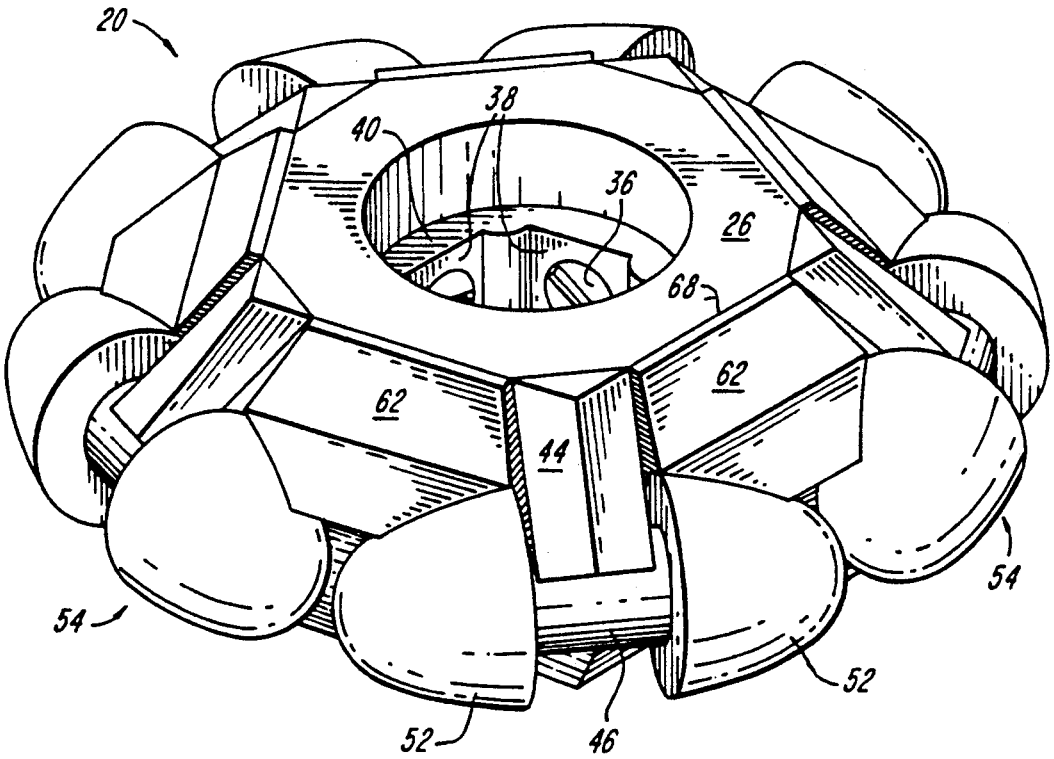
FIG. 5 is an oblique elevation of an assembled wheel.
Figure 4:
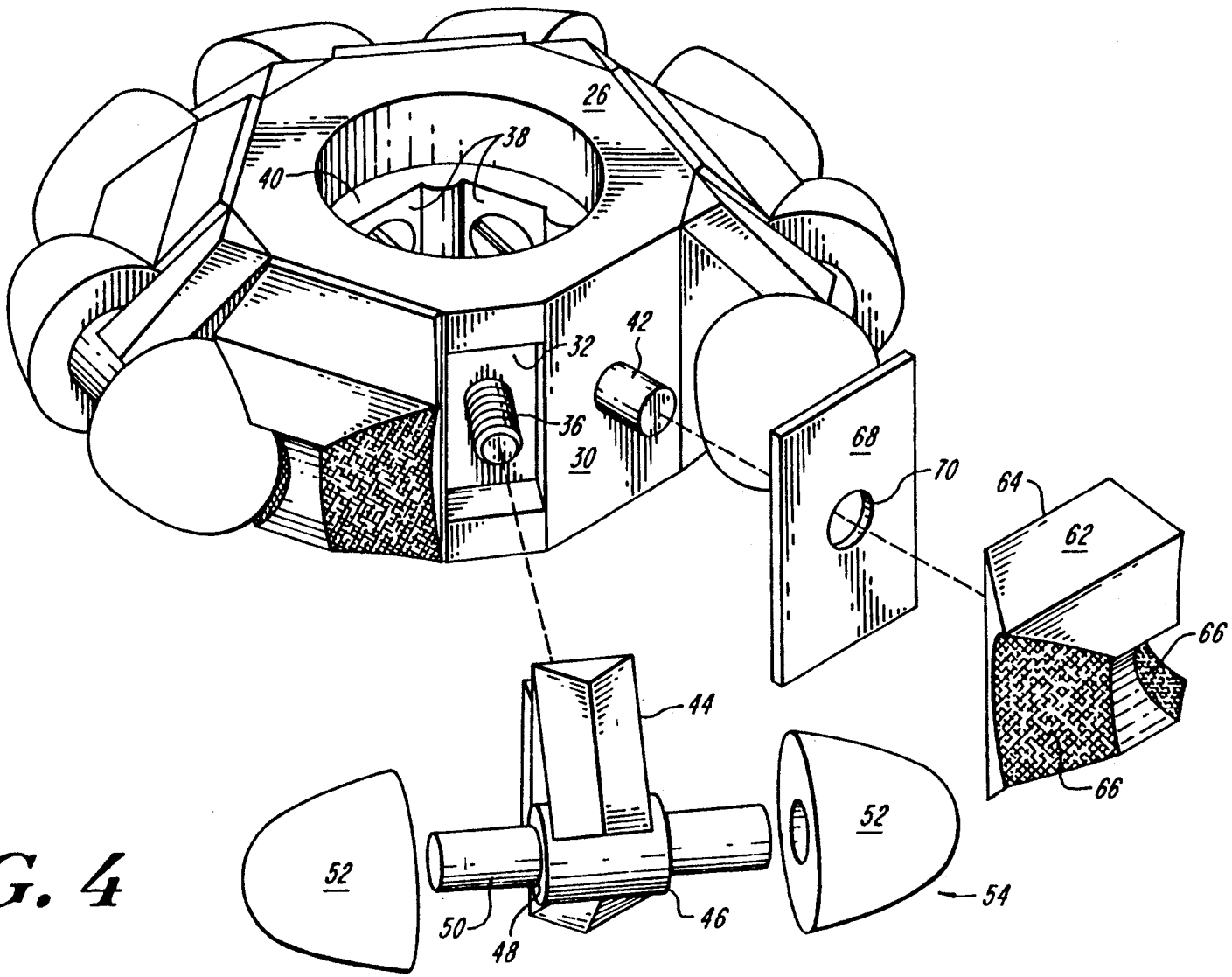
FIG. 4 is an exploded oblique elevation illustrating the assembly of the wheel.

FIGS. 2–5 illustrate the construction and assembly of a wheel 20. As shown in FIG. 3, the hub 26 has five flat faces 30, each pair of faces being separated by a rectangular recess 32. Centrally located in each of the recesses 32 is a radial countersunk hole 34 for receiving a flathead threaded machine screw 36. The screws 36 are inserted in the holes 34 from the hollow center of the hub 26, and the heads of the screws fit flush with the five sides 38 forming a thru hole in the hub 26. Preferably, the sides 38 are recessed from the ends of the hub, as shown, to provide shoulders 40 for receiving the bearings 24.

Centrally located on each of the flat faces 30 of the hub are integral radially projecting cylindrical posts 42.

Each of the recesses 32 is formed to receive a metal arm 44, the arm having a blind threaded hole for receiving a screw 36. The arm fits securely flush against the inner face of the recess 32, the screw being turned by a suitable angle driver inserted into the central hole through the hub. At its outer end the arm 44 has an integral cylindrical portion 46 forming a sleeve bearing 48 for receiving a roller shaft 50.

Roller parts 52 formed symmetrically about the axis 51 of the shaft 50, of hard rubber, polyurethane or a similar material, are press fit on the ends of the shaft 50.

Each assembly comprising an arm 44, a shaft 50 and roller parts 52 comprises a roller subassembly 54. As shown in FIG. 2, when each of the five subassemblies 54 is securely installed on the hub 26 by the screws 36, the surfaces of the roller parts 52 are formed and located so that an arc A-B of substantial length on each such part conforms to a circle 56 having its center in the axis 22 of the hub. When the wheel is in contact with a rolling surface 58, at least one of the roller parts 52 is in contact with the surface 58. Movement of the wheel 20 longitudinally of its axis 22 causes rotation of that roller 54 on its axis 51.

It will be further noted that the axes 51 of each of the rollers are all tangential to a common circle 60 having its center in the axis 22.

As thus far described, the hub 26 with the assembled rollers 54 comprises a complete wheel adapted for rolling in both the forward and lateral directions of the skate. In that case, lateral rolling is limited only by the friction in the bearings 48 on the roller shafts 50. If desired, the skate wheel may be used without additional components for applying friction to the rollers.

In most applications, additional friction on the rollers 54 is desired. For this purpose, there are provided a plurality of metal brakes 62 having flat surfaces 64 and formed surfaces 66, the latter shaped to conform to surfaces of the roller parts 52.

The brakes 62 have smooth blind holes for receiving the posts 42. Compression pads 68 in the form of flat sheets having central holes 70 are received on the posts 42 against the surfaces 30 of the hub and between the hub and the brakes 62. These sheets 68 are preferably formed of soft rubber or other resilient material.

In assembly, these compression pads 68 and brakes 62 are slipped on the posts 42, following which the arms 44 of the roller subassemblies are received in the recesses 32 of the hub and secured in place by the screws 36. The brakes 62 are held in place by their engagement with the assembled roller parts 52.

The thickness of the sheets 68 is predetermined so that they are in compression by reason of the engagement of the roller parts 52 with the brake surfaces 66. The brake surfaces 66 may be knurled or otherwise roughened to increase the friction. Thus, the use of thicker sheets 68 increases the force of frictional engagement of the roller parts 52 with the surfaces 66 on the brakes, and conversely the use of thinner sheets 68 reduces the force of frictional engagement.

In use, the improved skate wheel of this invention permits the desired control over the braking action of the skate on the rolling surface 58 by turning the forward direction of the skate by an angle relative to the forward motion of the skater. The action thus resembles a similar braking action with the use of ice skates.

Typically, the action results in a combination of motions, with the wheel 20 turning on its axis 22 to cause its rollers 54 to engage the rolling surface 58 successively, and with each roller rotating on its own axis 50 while momentarily in contact with the surface 58.

I claim:

1. A roller skate wheel comprising, in combination, a hub formed to receive a wheel bearing defining a wheel axis, and a plurality of rollers mounted on the hub in annularly spaced relationship, the rollers each being rotatable about a roller axis tangential to a first circle on the wheel axis and having a major surface symmetrical about the roller axis, said major surface conforming to a second circle on the wheel axis for contact with a skating surface, the hub having friction means thereon in position to bear upon a portion of said major surface of each roller.

2. A roller skate wheel comprising, in combination, a hub formed to receive a wheel bearing defining a wheel axis and having a plurality of annularly spaced arms projecting radially therefrom, each arm having a bearing defining a roller axis tangential to a first circle on the wheel axis, a roller mounted in the bearing on each arm and having a major surface symmetrical about the roller axis, said major surface conforming to a second circle on the wheel axis for contact with a skating surface, and friction means supported between the arms in position for compression between the hub and the rollers.

3. A wheel assembly for a roller skate comprising, in combination, a bracket adapted to attachment to a boot and having a plurality of wheel bearings on wheel axes each extending laterally of a common forward skating direction, said wheel axes being mutually spaced in said direction, and a plurality of wheels each having a hub mounted for rotation of one of said bearings, each hub having a plurality of rollers mounted annularly thereon, the rollers having peripheral surfaces conforming to a common circle for rolling on a skating surface, each roller having means for applying frictional resistance to rotation of said roller about a roller axis tangential to a circle centered on the wheel axis about which its hub rotates and being adapted for rolling about its axis upon contact with the skating surface when said wheel assembly is moving at an angle to said direction.

4. A roller skate wheel according to claim 1, in which the friction means comprises a brake conformingly engaging a portion of said major surface and means resiliently compressed between the hub and the brake.

5. A roller skate wheel according to claim 4, in which the last mentioned means comprises a sheet of compressible resilient material.

6. A roller skate wheel according to claim 2, in which the friction means comprises a brake conformingly engaging a portion of said major surface and means resiliently compressed between the hub and the brake.

7. A roller skate wheel according to claim 6, in which the last mentioned means comprises a sheet of compressible resilient material.

8. A wheel assembly according to claim 3, in which the rollers have shafts received in sleeve bearings on the hub.

9. A wheel assembly according to claim 3, in which the hub is adapted for frictionally engaging the peripheral surfaces of rollers.

10. A wheel assembly according to claim 3, including brakes mounted on the hub and frictionally engaging the rollers.

11. A wheel assembly according to claim 10, including means for adjusting the frictional engagement of the brakes with the rollers.

12. A wheel assembly according to claim 10, including resilient compression pads mounted between the brakes and the hub.

* * * * *

UNITED STATES PATENT AND TRADEMARK OFFICE

CERTIFICATE OF CORRECTION

PATENT NO. : 5,246,238

DATED : September 21, 1993

INVENTOR(S) : Nathaniel R. Brown

It is certified that error appears in the above-identified patent and that said Letters Patent is hereby corrected as shown below:

Column 4, line 13, cancel "to" (first occurrence) and substitute --for--;
line 19, cancel "of" (first occurrence) and substitute --on--;
line 27, after "its" insert --roller--;
line 49, after "of" insert --the--

Signed and Sealed this

Fifth Day of July, 1994

Bruce Lehman

*Attest:*

BRUCE LEHMAN

*Attesting Officer*

*Commissioner of Patents and Trademarks*